US009499300B2

(12) United States Patent
Deltour

(10) Patent No.: US 9,499,300 B2
(45) Date of Patent: Nov. 22, 2016

(54) CLOSURE FOR AN EASY OPENING CONTAINER AND A CONTAINER PROVIDED WITH SUCH CLOSURE

(75) Inventor: Bernard Deltour, Crosmieres (FR)

(73) Assignee: Impress Group B.V., Deventer (NL)

( * ) Notice: Subject to any disclaimer, the term of this patent is extended or adjusted under 35 U.S.C. 154(b) by 0 days.

(21) Appl. No.: 13/388,548

(22) PCT Filed: Mar. 15, 2011

(86) PCT No.: PCT/EP2011/053873

§ 371 (c)(1),
(2), (4) Date: Apr. 16, 2012

(87) PCT Pub. No.: WO2011/113823

PCT Pub. Date: Sep. 22, 2011

(65) Prior Publication Data

US 2012/0193360 A1 Aug. 2, 2012

(30) Foreign Application Priority Data

Mar. 18, 2010 (EP) ..... 10075120

(51) Int. Cl.
*B65D 17/34* (2006.01)
*B65D 17/50* (2006.01)

(52) U.S. Cl.
CPC ..... *B65D 17/502* (2013.01); *B65D 2517/0013* (2013.01); *B65D 2517/0085* (2013.01); *B65D 2517/5013* (2013.01); *B65D 2517/5027* (2013.01); *B65D 2517/5032* (2013.01); *B65D 2517/5048* (2013.01); *B65D 2517/5054* (2013.01)

(58) Field of Classification Search
CPC ..... B65D 17/502; B65D 2517/0013; B65D 2517/5083
USPC ..... 220/359.2, 257.2; 402/26
See application file for complete search history.

(56) References Cited

U.S. PATENT DOCUMENTS 4,637,543 A 1/1987 Kucherer
4,834,259 A * 5/1989 Kubis et al. ..... 220/359.2

FOREIGN PATENT DOCUMENTS

DE 3413918 A1 10/1985
EP 0357276 A1 3/1990
WO 2007099066 A1 9/2007

* cited by examiner

*Primary Examiner* — Fenn Mathew
*Assistant Examiner* — Kevin Castillo
(74) *Attorney, Agent, or Firm* — The Webb Law Firm

(57) ABSTRACT

The present invention relates to a closure (1) for an easy opening container comprising a support and a foil (3) adhered to the support, which foil is provided with a tab (4) folded on to the foil, wherein the foil comprises a central concave section (5) and at least a flat section (6) beneath the tab, where optionally the tab is adhered to the flat section, and to a container comprising such closure.

8 Claims, 5 Drawing Sheets

CLOSURE FOR AN EASY OPENING CONTAINER AND A CONTAINER PROVIDED WITH SUCH CLOSURE

BACKGROUND OF THE INVENTION

Field of the Invention

The present invention relates to a closure for an easy opening container and to a container provided with such closure.

Description of Related Art

Easy opening closures are used for closing an opening of a container with a foil, such that relatively easy by removing the foil the content of the container will become available to the consumer. The foil is generally relatively vulnerable and is released from its container support by gripping a tab, which is connected to or integral with the foil. Lifting the tap and exerting relatively low force will result in a detachment of the foil from the container support. After filling and closing the container with the easy opening foil, the foil is protected by a cap which overdoses the foil and is connected to the container. In use, the user first removes the protective cap and subsequently the foil by gripping the tap and peeling off the foil.

Such easy opening containers are also used for goods, such as food, that are to be subjected to a heat treatment after closing the container. Generally, the tab is adhered to the foil and thereafter the foil is provided with the desired shape and form. This may negatively influence the adherence of the tab to the foil.

Over pressure build up in the container during heat treatment, for instance a sterilization process will result in an outward bulging of the easy opening foil, even outside the confinement of the container. This may result in damage of the foil and/or damage to the tap. Eventually, this may result in a failure of the foil or that the tap is no longer available for opening the container by peeling of the foil.

This risk for damage to foil and/or tap of an easy opening container is relatively high, when such easy opening containers are subjected to a heating treatment during which the containers are transported through the heat treatment apparatus, such as a retort apparatus, following conveyors and/or guiding rails.

SUMMARY OF THE INVENTION

The present invention has for its object to provide a closure and a container provided with an easy opening foil which have a substantially reduced risk for damage of the foil and/or the tap during and after a heat treatment.

Accordingly, the present invention provides a closure for an easy opening container comprising a support and a foil adhered to the support, which foil is provided with a tab folded on to the foil, wherein the foil comprises a central concave section and at least a flat section beneath the tab. The tab is thus first adhered to the flat foil section underneath. Then the foil is shaped and provided with the concave form leaving undisturbed the flat foil section during the forming process (no shearing of the glue during the forming) In this manner, the tab will stay better attached to the foil and subsequently during all the steps of the use of this end (during heat treatment, conveyors, rails, handling) and the chance to have the tab damaged will be reduced. Obviously, the flat section can have different forms like annular and exocentric flat section.

Due to the presence of a central concave section (extending inwardly of the container) and a flat foil section beneath the tab, the foil and the tab will move outwardly to such extent, that it can extend beyond the confinement. Dependant on the diameter of the container, it could bulged out up to about 20 mm on a large diameter. Preferably, the tab and foil substantially do not extend beyond (the confinement of the closure. In other words, foil and tab do not extend outside the confinement of the closure and therefore is the risk of sticking or hooking to parts of the apparatus substantially avoided. The concave section will bulge outwardly and when in contact with the tab, the tab will follow the outward movement of the foil. However, due to the presence of the flat section beneath the tab, this part of the foil will move to a lesser extent outwardly and thereby avoids the tab of projecting beyond the confinement of the closure.

According to a preferred embodiment, the tap is folded onto the concave section. This will increase the distance of the tap to the confinement of the closure and therefore further reduces a risk of projecting beyond the confinement of the closure.

The outward bulging of the concave section is further reduced, and the making of the foil is further simplified if, according to another preferred embodiment of the invention, the flat section extends over the circumference of the support. The outward movement of the concave section is further reduced at the same relative overpressure when the flat section extends radially inwardly over and beyond the support. That is, the width of the flat section is larger than the support to which the foil is adhered. Practically it is preferred that the flat section extends over a length L of about 1-15 mm, such as 2-12 mm, in particular 3-10 mm over and beyond the support.

In order to further reduce undesired lifting and extension of the tab beyond the confinement, it is further preferred that the tab is adhered to the foil via the flat section. According to a preferred embodiment, the tab is adhered to the foil by adhesive. This has the advantage that the adhesive is applied and present on the flat section and the tab will remain at this location undisturbed when thereafter the concave central section is formed in the foil. Adhesive will not be transported to the outside of the space between the flat section and the overlaying tap, because this part of the foil is not disturbed when forming the central concave section. According to another alternative embodiment the tab is adhered to the foil by mechanical structure. This means that the flat section and the tap are entangled which resists separation of the tab from the flat section. Obviously, such mechanical structure is preferably formed and applied in a flat section of an undisturbed part of the foil.

Preferably the free end of the tab does not contact the foil thereby providing an elegant finger access.

The construction of the closure according to the invention is such that at a pressure build up of about 0.1-2.5 bar the tab and foil remain within the confinement of the support.

The present invention is applicable for easy opening foils independent of the form of the support to which the foil is adhered. According to a preferred embodiment this support is part of a ring which is to be connected to a container body. Accordingly, the foil can be adhered to a ring support. Subsequently, the ring with the adhered foil is applied to a container body after filling the container body via the same opening. It is also possible, that the support is not present in a separate ring, but is formed at the free end or in the wall of the container body. It is then possible that the container is first filled and subsequently the foil applied, or that the container after application of the foil is filled from the other open container body end.

A foil to be used in relation to the present invention may be made of any suitable material which may be characterized as a foil, because it has a thickness of about 0.02 to 1.0 mm, preferably 0.05 to 0.5 mm. The foil may be provided with a surface structure or be imprinted. The material of the foil may be metal, such as aluminium, or plastic, such as polypropylene, or may have the form of a metal foil provided with a plastic laminate. A further aspect of the present invention relates to a container provided with a closure as defined and characterized herein before.

BRIEF DESCRIPTION OF THE DRAWINGS

Mentioned and other features and characteristics of the closure and container of the present invention will be further illustrated with reference to particular embodiments which are given for illustrative purposes without any intention for limitation of the present invention. In that respect reference will be made to drawings, wherein.

DESCRIPTION OF THE PREFERRED EMBODIMENTS

Figure 1:
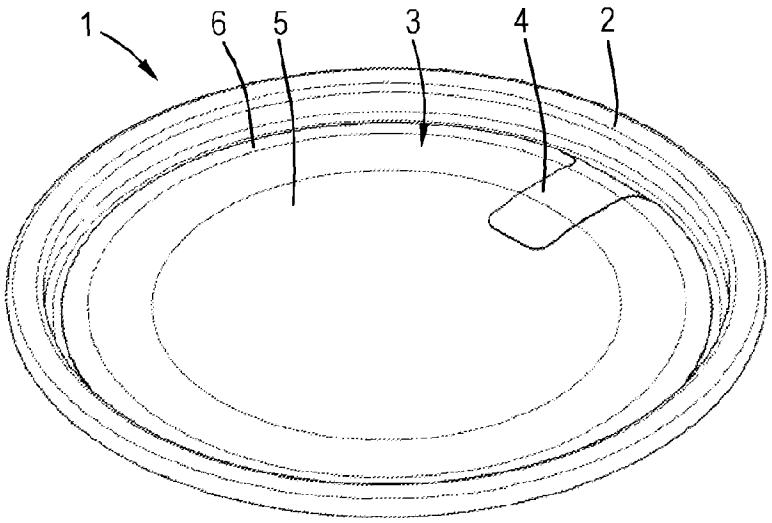
FIG. 1: a prospective view of an easy opening closure according to the invention.

FIG. 1 shows a closure 1 according to the invention. The closure 1 comprises a ring 2 to which is adhered a foil 3. The foil 3 comprises a tab 4 which is integral with the foil 3 and is folded over and onto the foil 3. The foil further comprises a central concave section 5 surrounded by an annular flat section 6.

Figure 2:
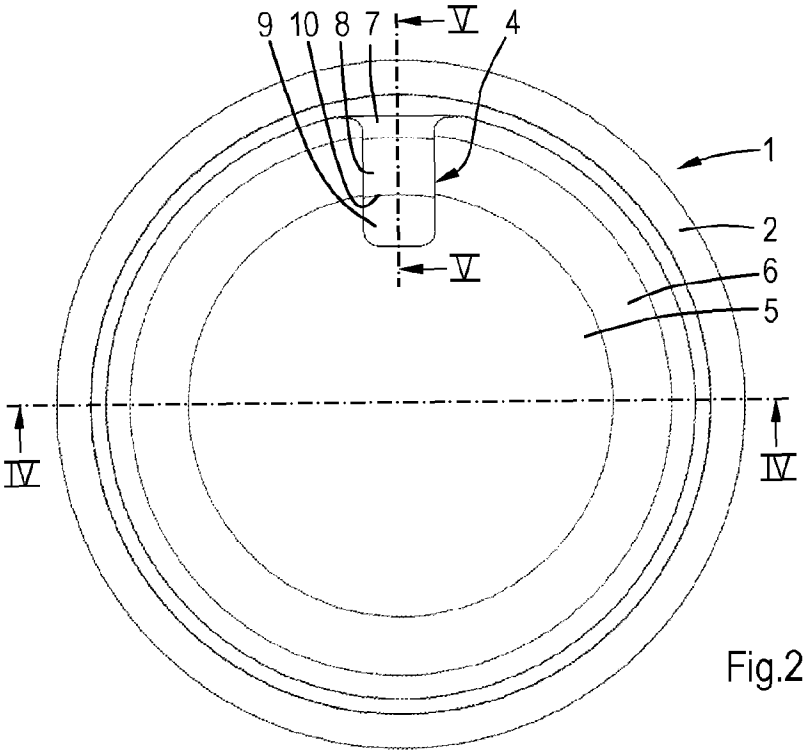
FIG. 2: a top view of the closure of FIG. 1.

FIG. 2 shows that the tab 4 has a folded part 7 connected to an intermediate tab part 8 and a free end tab part 9. The intermediate tab part 8 extends over the annular flat section 6 and the fee end tab part 9 extends over the central concave section and is folded towards this section by a fold line 10.

Figure 4:
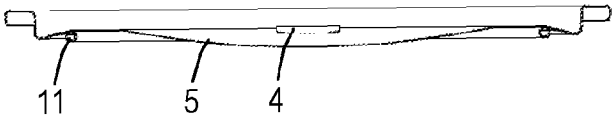
FIG. 4: a cross-section of the closure of FIG. 1.
Figure 3:
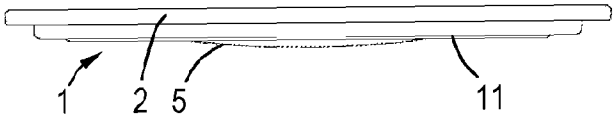
FIG. 3: a side view of the closure of FIG. 1.

FIG. 3 shows in side view the closure 1 according to the invention with the central concave section 5 extending beneath the lower confinement 11 of the closure 1. A similar view is given in the cross-section according to FIG. 4.

Figure 5:
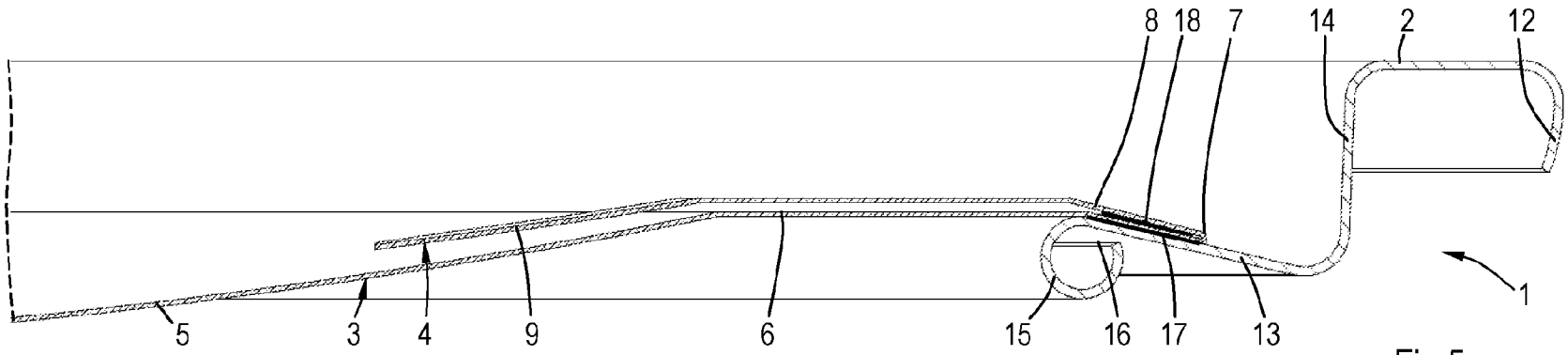
FIG. 5: at a larger scale a cross-section over the line V-V in FIG. 2.

FIG. 5 shows more in detail the closure 1 according to the invention. The ring 2 comprises an outer curl 12 which may be seamed onto a body of a container (not shown). The ring has a flat ring support 13 connected to the curl 12 via a ring wall 14. The flat ring support 13 ends in a curl 15 of which the curl end 16 faces the ring support 13. The foil 3 at the flat section 6 is adhered to the ring support 13 using adhesive 17. In stead of adhesive, heat sealing may be used in the alternative. The tab 4 with its intermediate tab part 8 is adhered to the foil 6 using adhesive 18. It is noted that the flat section 6 has a very large angle due to the slanted position of the flat ring support 13. The tab 4 follows the form of the foil 3 because the structuring of the foil 3 takes place after the bending over and adherence with adhesive 18 of the tab 4 to the foil 6.

Figure 6:
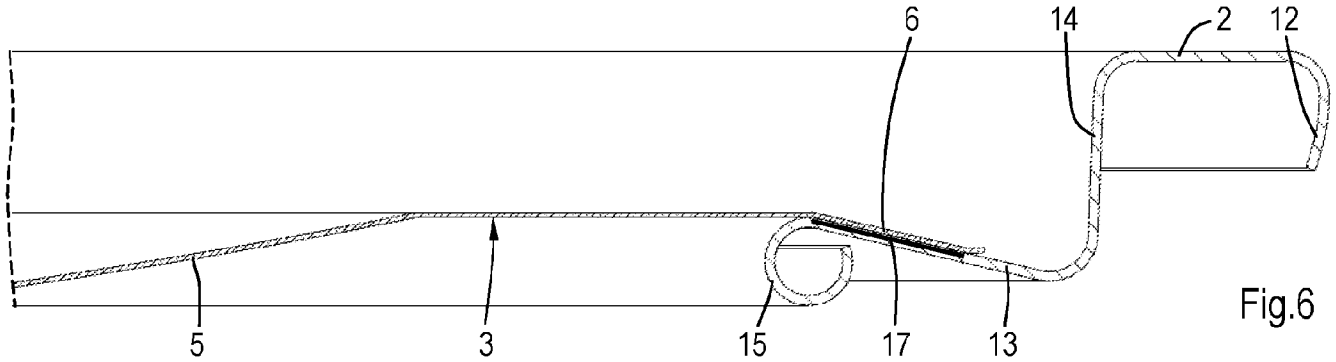
FIG. 6: at a larger scale a cross-section over the line IV-IV in FIG. 2.

FIG. 6 shows the adherence of the foil 3 with its flat section 6 to the ring support 13 using adhesive 17.

Figure 4A:
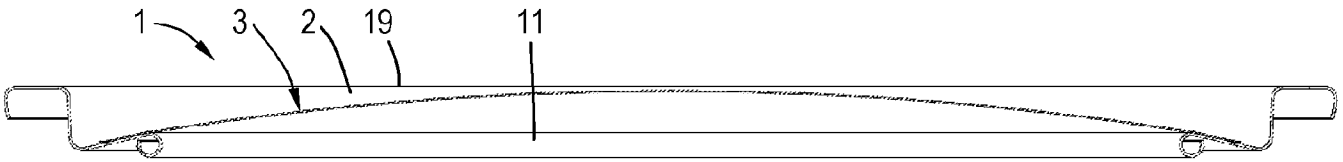
FIG. 4A: the closure in the overpressure status.
Figure 7:
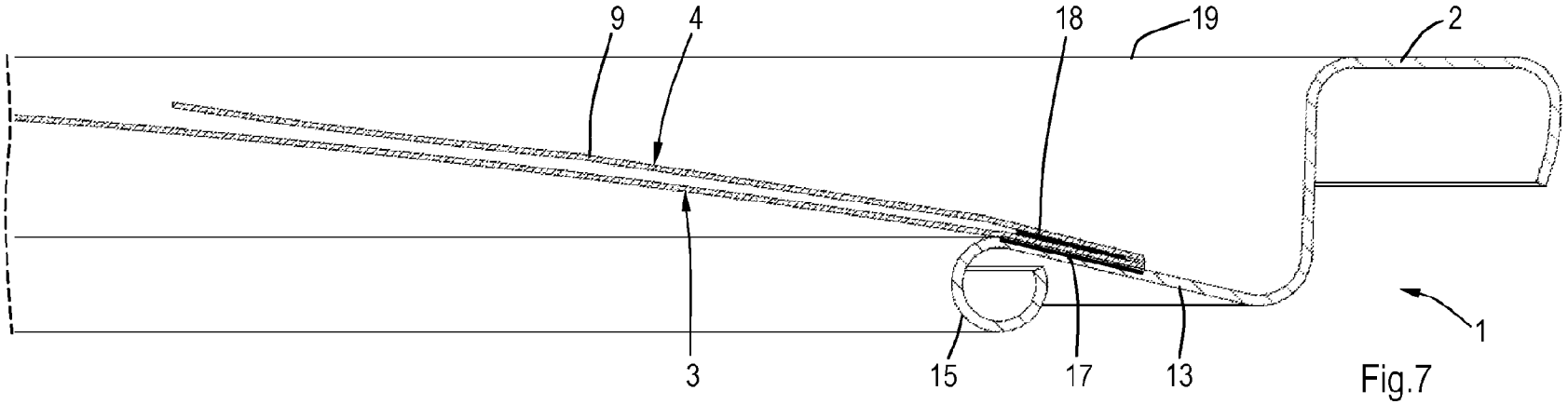
FIG. 7: a cross-section corresponding to FIG. 5 showing the bulging or foil and tap due to over pressure.

FIGS. 4A and 7 show the shape of the foil 3 and the tab 4 when pressure build up occurs in a container provided with a closure 1 according to the invention. It is shows that the foil 3 bulges outwardly and transformed the concave section into a convex section and that with this transformation also moved the tab 4. However, the foil 3 and in particular the free end 9 of the tab 4 remained within the confinement 19 of the closure 1. At larger diameter the free end 9 and the tab 4 may extend beyond the confinement as well, if so desired.

Figure 8:
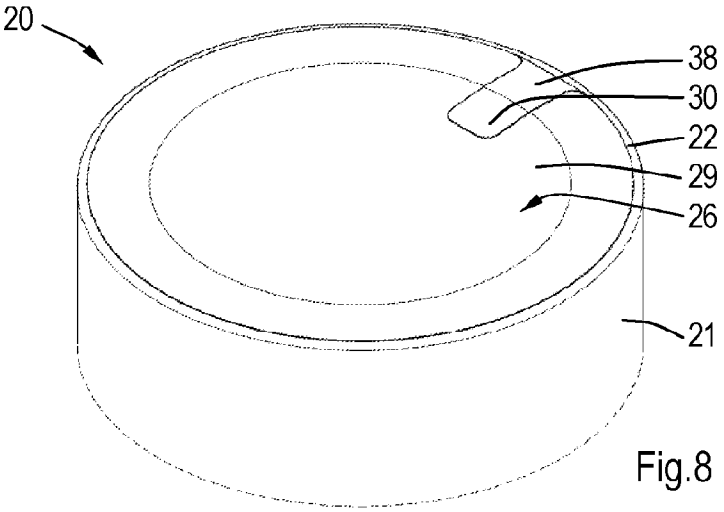
FIG. 8: another embodiment of the closure according to the present invention.
Figure 8A:
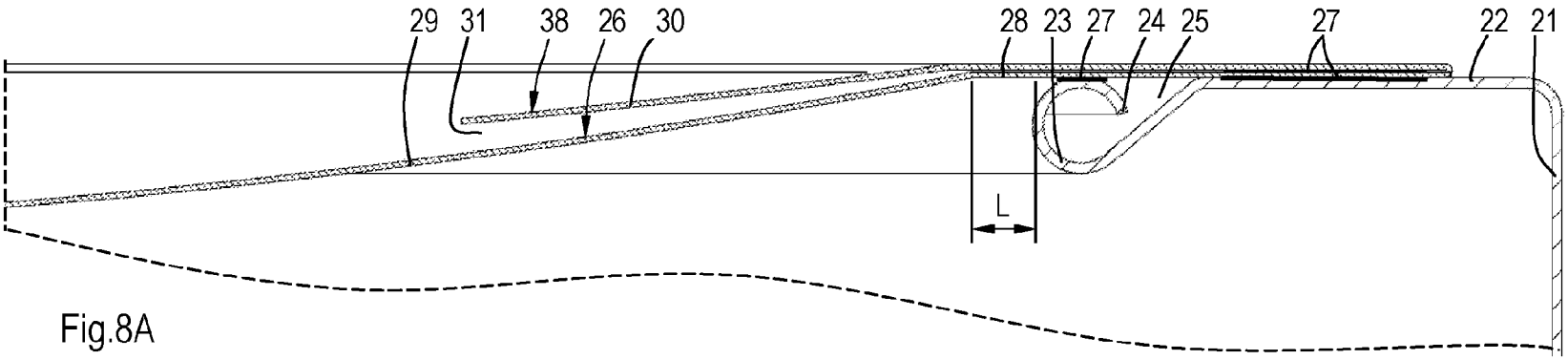
FIG. 8A: a cross-section similar to FIG. 5 of the closure of FIG. 8.

FIGS. 8 and 8A show another closure 20 according to the invention. A container body 21 is provided with a support 22 ending in a curl 23 which is counter clockwise curled such that the curl end 24 faces the curl 23. A curl gap 25 is closed off by the foil 26 which is adhered to the curl 23 and to the support 22 by adhesive 27 (heat sealing may also be used).

According to the invention, the foil 26 is provided with an annular flat section 28 extending over a length L of about 6 mm beyond the support 22 and the curl 23. The foil 26 is further provided with a concave central section 29. The tab 38 which is integral with the foil 26 is folded over the flat section 28 and connected thereto using adhesive 27. The tab 38 is further comprising a free tab end 30 which is folded along the concave foil section 29. After having been subjected to a heat treatment and after balancing the internal pressure again by cooling, the free end 30 will have slightly separated from the concave central section 29 thereby providing a finger access 31.

Figure 9:
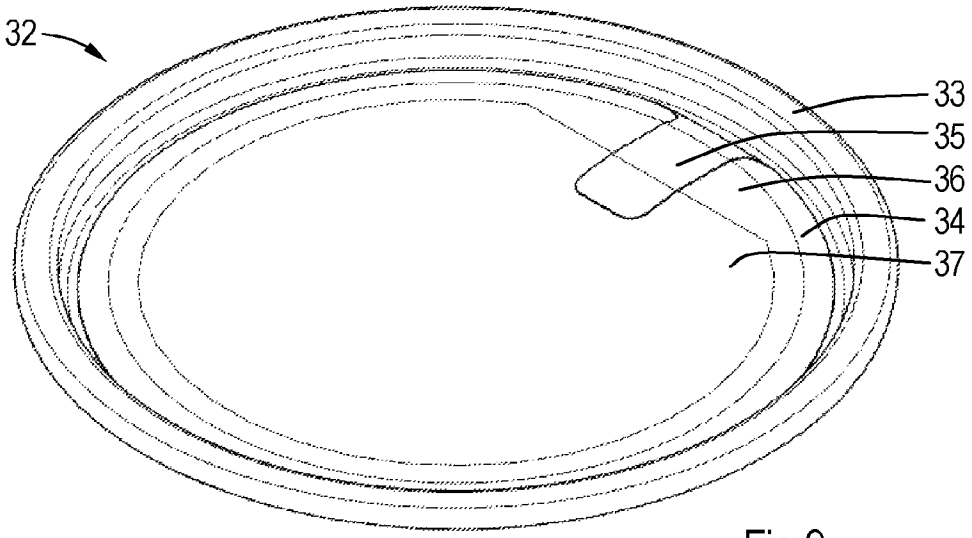
FIG. 9: shows a perspective view of another closure according to the invention.

FIG. 9 shows a closure 32 according to the invention. The closure 32 comprises a ring 33. The foil 34 is adhered to a non-shown ring support using adhesive. The foil 34 comprises an integral tab 35 which is folded over and on the foil 34.

The foil 34 comprises a flat foil section 36 extending beneath and lateral of the tab 35. This implies that the concave central foil section 37 extends almost over the entire circumference except for the flat foil section 36. Still, this closure with the foil and tap according to the invention and remain within the confinement of the ring 33 during over pressure build up in the container to which the closure 32 connected to.

The invention claimed is:

1. A closure for an easy opening container comprising:

a ring comprising a flat ring support connected via a ring wall to an outer curl, the flat ring support being located at a lower level than the ring; and a foil adhered to the flat ring support, which foil is provided with a tab comprising a folded part connected via an intermediate tab part to a free end tab part, which tab is folded on to the foil and is in contact with the foil, wherein the foil comprises a central concave section and at least a flat section beneath the intermediate tab part, the intermediate tab part being folded over and onto the flat section such that the intermediate tab part is in contact with the flat section, wherein a surface of the intermediate tab part facing the foil is adhered to an upper surface of the flat section of the foil with an adhesive and a lower surface of the flat section of the foil is adhered to the flat ring support such that after pressure build up in the container, the foil remains within a confinement of the closure with the tab remaining attached to the foil within the confinement of the closure, and wherein the flat section extends radially inwardly a length L of 3-10 mm beyond the flat ring support.

2. The closure according to claim 1, wherein the tab is folded on to the concave section.

3. The closure according to claim 1, wherein the flat section extends over the circumference of the flat ring support.

4. The closure according to claim 1, wherein the tab is adhered to the foil via the flat section.

5. The closure according to claim 1, wherein the free end tab part of the tab provides for finger access.

6. The closure according to claim 1, wherein the ring is to be connected to a container body.

7. The closure according to claim 1, made of metal, plastic, or plastic laminated metal.

8. A container provided with a closure according to claim 1.

* * * * *